US007394008B2

(12) United States Patent
May

(10) Patent No.: US 7,394,008 B2
(45) Date of Patent: Jul. 1, 2008

(54) CARRIER ASSEMBLY FOR PERCUSSION INSTRUMENTS

(76) Inventor: Randall L May, 2 Trafalgar, Newport Beach, CA (US) 92660-6830

( * ) Notice: Subject to any disclaimer, the term of this patent is extended or adjusted under 35 U.S.C. 154(b) by 49 days.

(21) Appl. No.: 11/112,342

(22) Filed: Apr. 22, 2005

(65) Prior Publication Data

US 2005/0183565 A1 Aug. 25, 2005

Related U.S. Application Data

(60) Continuation-in-part of application No. 10/950,130, filed on Sep. 27, 2004, which is a continuation-in-part of application No. 10/831,638, filed on Apr. 23, 2004, now Pat. No. 6,881,886, which is a continuation-in-part of application No. 10/374,676, filed on Feb. 26, 2003, now Pat. No. 7,071,401, which is a continuation-in-part of application No. 10/170,005, filed on Jun. 10, 2002, now Pat. No. 6,770,805, which is a continuation-in-part of application No. 09/756,479, filed on Jan. 8, 2001, now Pat. No. 6,403,869, which is a division of application No. 09/497,266, filed on Feb. 3, 2000, now Pat. No. 6,329,583, which is a continuation-in-part of application No. 08/976,999, filed on Nov. 24, 1997, now Pat. No. 6,028,257, which is a continuation-in-part of application No. 08/588,244, filed on Jan. 18, 1996, now Pat. No. 5,691,492.

(51) Int. Cl.
*G10D 13/02* (2006.01)

(52) U.S. Cl. ..... 84/421; 224/265

(58) Field of Classification Search ..... 84/421, 84/402; 224/265, 266; D3/204, 215
See application file for complete search history.

(56) References Cited

U.S. PATENT DOCUMENTS

| | | | | |
|---|---|---|---|---|
| 1,191,425 | A * | 7/1916 | Huddle | 108/43 |
| 3,106,350 | A * | 10/1963 | Wiltse et al. | 362/108 |
| 4,256,007 | A | 3/1981 | Streit | |
| 4,298,149 | A * | 11/1981 | Gottschalk et al. | 224/201 |
| 4,387,839 | A | 6/1983 | Dranchak | |
| 4,402,441 | A | 9/1983 | Jones et al. | |
| 4,453,442 | A | 6/1984 | LaFlame | |
| 4,453,446 | A | 6/1984 | Hoshino | |
| 4,605,144 | A | 8/1986 | LaFlame | |

(Continued)

OTHER PUBLICATIONS

U.S. Appl. No. 10/374,676, filed Nov. 2003, May.

(Continued)

*Primary Examiner*—Lincoln Donovan
*Assistant Examiner*—Jianchun Qin
(74) *Attorney, Agent, or Firm*—Buhler & Associates; Kirk A. Buhler

(57) ABSTRACT

Drum hardware and drum secured thereon are preferably supported on a vest type carrier or a T-bar carrier having a plurality of separate parts removable from each other and formed of a rigid plastic, light metal such as magnesium, aluminum or titanium. The removable hardware includes a removable back support member. The instrument carrier includes an expandable and or adjustable front section(s) that allows for at least one front adjustment of the carrier to adjust the overall length of the carrier to accommodate users of different sizes.

16 Claims, 11 Drawing Sheets

U.S. PATENT DOCUMENTS 4,634,032 A * 1/1987 LaFlame ..... 224/265
4,796,508 A 1/1989 Hoshino
4,799,610 A * 1/1989 Hsieh ..... 224/266
5,062,558 A * 11/1991 Stang ..... 224/270
5,074,222 A * 12/1991 Welch ..... 108/43
5,076,131 A * 12/1991 Patterson ..... 84/421
5,400,683 A 3/1995 LaFlame
5,421,499 A * 6/1995 Bauer ..... 224/270
5,464,137 A * 11/1995 Shirdavani ..... 224/265
5,520,292 A 5/1996 Lombardi
5,573,158 A 11/1996 Penn
D388,246 S * 12/1997 Patterson ..... D3/204
5,973,247 A * 10/1999 Matthews ..... 84/402
6,028,257 A 2/2000 May
6,172,290 B1 1/2001 May
6,323,407 B1 11/2001 May
6,329,583 B1 12/2001 May

OTHER PUBLICATIONS

U.S. Appl. No. 10/170,005, filed Jan. 2003, May.
U.S. Appl. No. 09/756,479, filed Dec. 2001, May.

* cited by examiner

CARRIER ASSEMBLY FOR PERCUSSION INSTRUMENTS

CROSS REFERENCE TO RELATED APPLICATION

This application is a continuation-in-part of parent application Ser. No. 08/588,244, filed Jan. 18, 1996 now U.S. Pat. No. 5,691,492, which is a continuation-in-part of U.S. patent application Ser. No. 08/976,999 filed Nov. 24, 1997, now U.S. Pat. No. 6,028,257 which is a divisional application of U.S. patent application Ser. No. 09/497,266 filed Feb. 3, 2000 now U.S. Pat. No. 6,329,583 which is a continuation-in-part of U.S. patent application Ser. No. 09/756,479 filed Jan. 8, 2001 now U.S. Pat. No. 6,403,869 which is a continuation-in-part of U.S. patent application Ser. No. 10/170,005, filed Jun. 10, 2002, now U.S. Pat. No. 6,770,805 which is a continuation-in-part of U.S. patent application Ser. No. 10/374,676 filed Feb. 26, 2003 now U.S. Pat. No. 7,071,401 which is a continuation in part of U.S. patent application Ser. No. 10/831,638 filed Apr. 23, 2004, now U.S. Pat. No. 6,881,886 which is a continuation in part of U.S. patent application Ser. No. 10/950,130 filed Sep. 27, 2004 which are incorporated by reference herein and made a part of this disclosure.

FIELD OF THE INVENTION

This invention relates to new and useful improvements in apparatus for carrying percussion instruments, particularly drums of various kinds, cymbals, xylophones, and the like. More particularly, the present invention relates to a carrier hardware providing a novel support for percussion instruments and to carrier assemblies supporting percussion instruments on a person while standing, walking or marching. The carrier assembly has a construction and relationship of parts to transfer the weight of the percussion instrument(s) to the body of a person.

A front adjustment member or members allow the overall length of the carrier to be adjusted to accommodate users of different sizes. The carrier adjustment can be configured for use with tubular, T-bar and vest type constructed carriers. The adjustment uses tubes, rods, plates or other member to allow incremental or linear adjustment of the components. Multiple links can exist in the front of the carrier to allow for a multitude of adjustments.

The person carrying the instruments maintains a stable attitude while walking or marching about and avoids pressure or other forms of detrimental forces on the shoulders and lower back and is further characterized by having removable and/or adjustable back support member or members. The adjustment to the back support member position may also be accomplished using a fixed back support member with adjustable shoulder straps. The back member may be secured to the shoulder straps and the shoulder straps may be removable and or adjustable to accommodate different sized users.

BACKGROUND OF THE INVENTION

Prior art discloses many examples of apparatus for supporting percussion instruments but none providing the combination of features disclosed and claimed herein.

La Flame U.S. Pat. No. 5,400,683 discloses a carrier for percussion instruments having an abdominal plate connected at one end of a unitary frame partly encircling the wearer at the waist and having an upstanding rear portion pivotally connected to a back pressure plate. Shoulder bars are connected to the back pressure plate, and wrap about shoulders and support straps connect to the abdominal plate, which has suitable fixtures for attachment of various percussion instruments. This invention does not disclose a vest type construction instrument carrier.

La Flame GB patent 2,123,676 (based on U.S. Pat. No. 4,453,442) discloses a carrier for percussion instruments or the like which includes the combination of a belly plate with a carrier bracket for supporting an instrument at an outwardly-overhung position about a fulcrum area of contact with the front waistline area of the person. The patent includes a rigid band with a generally bent contour to extend along a portion of the waistline area of the person to the back of the person. The patent includes a back-plate riser arm supported by the ban to extend in a generally upward direction such that a portion of the arm will extend along the back thoracic region of the person, and means carried by the arm for imparting to the thoracic back region of the person. The arm causes a reactive force to the overhung weight of the instrument about the aforesaid means forming a fulcrum area of contact with the person.

May U.S. Pat. No. 5,691,492 discloses hardware for supporting drums that is of a hinged construction and has one part of the hinge connectable to an external support, e.g., J-rods on a fixed support or a marching drum carrier. Another part of the hinge is connectable to the shell of a drum or to the tension rods on a drum or to other hardware on the drum.

May U.S. Pat. No. 6,028,257 shows drum hardware and drums secured thereon preferably supported on a vest type carrier or a T-bar carrier or a fixed post or pedestal.

May U.S. Pat. No. 6,323,407 discloses hardware and drums secured thereon preferably supported on a vest type carrier made of tubular construction.

May U.S. Pat. No. 6,329,583 discloses hardware and drums secured thereon preferably supported on a vest type carrier or a T-bar carrier with adjustable vest components.

May U.S. Pat. No. 6,403,869 discloses hardware and drums secured thereon preferably supported on a vest type carrier or a T-bar carrier with adjustable vest components.

The prior art discloses many examples of apparatus for supporting percussion instruments but none providing the combination of features disclosed and claimed needs.

BRIEF SUMMARY OF THE INVENTION

One of the objects of this invention is to provide a new and improved carrier that allows for adjustment in the front of the carrier to accommodate users of different sizes.

Another object of the invention is to provide a front adjustable carrier with removable back support for a carrier assembly for musical instruments.

Another object of the invention is to provide a removable back support that is padded to improve comfort to the user.

Another object of the invention is to provide the removable back support member that allows for width adjustment.

One object of the invention is to provide a new and improved carrier for percussion instruments, e.g., a snare drum, having hardware with a removable back bar, back plate, back member, back members, back support member or back pressure plate.

Another object of the invention is to provide adjustment to the back support member where the back support member is attached to adjustable shoulder straps wherein adjustment to the shoulder straps, moves the back support member.

Another object of the invention is to provide an adjustable front section that allows for incremental adjustments.

Another object of the invention is to provide an adjustable front section that allows for an infinite number of adjustment positions.

Another object of the invention is to provide a new and improved carrier for percussion instruments comprising a novel supporting vest of composite material (Fiberglas), rigid removable shoulder straps of light metal, and back member of light metal such as aluminum, magnesium, etc.

Another object of the invention is to provide a back member that is secured to shoulder straps that are removable and or adjustable to accommodate different sized users. The securing method may be rigidly secured or secured with fasteners that allow the back member to pivot on the shoulder straps. The secured back member may be adjustable for width.

Another object of the invention is to provide a new and improved carrier for percussion instruments, e.g., a snare drum, having hardware for supporting a drum comprising a plate with bosses having holes to receive J-rods.

Another object of the invention is to provide a new and improved carrier for percussion instruments comprising a novel supporting vest.

Another object of the invention is to provide a new and improved carrier for percussion instruments comprising a novel supporting vest having four separate pieces, a two or more front piece vest of composite material (Fiberglas) with an adjustment between the front pieces, rigid shoulder straps of light metal, and back bar of light metal such as aluminum, magnesium, etc.

Another object of the invention is to provide a new and improved carrier for percussion instruments comprising a novel T-bar carrier with belly plate, shoulder straps, and back bar of light metal such as aluminum, magnesium, etc.

Another object of the invention is to provide a new and improved carrier for percussion instruments comprising a novel T-bar carrier with belly plate, shoulder straps, and back bar of light metal such as aluminum, magnesium with J-bars mounted on the carrier for supporting cymbals or other percussion instruments.

Another object of the invention is to provide a new and improved carrier for percussion instruments comprising a novel T-bar carrier with belly plate, shoulder straps, and back bar of light metal such as aluminum, magnesium with a fluted tube mounted on the carrier having adjustably pivoted arms for supporting cymbals or other percussion instruments in a variety of positions.

Another object of the invention is to provide a new and improved carrier for percussion instruments comprising a novel T-bar carrier with belly plate, shoulder straps, and back bar of light metal such as aluminum, magnesium with J-rod receptors on the belly plate and a fluted tube mounted on extensions to the ends of the belly plate having adjustably pivoted arms for supporting cymbals or other percussion instruments in a variety of positions.

Still another object of the invention is to provide a new and improved carrier for percussion instruments comprising a novel T-bar carrier having a construction permitting almost universal adjustment of the points of attachment and location of the percussion instruments.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
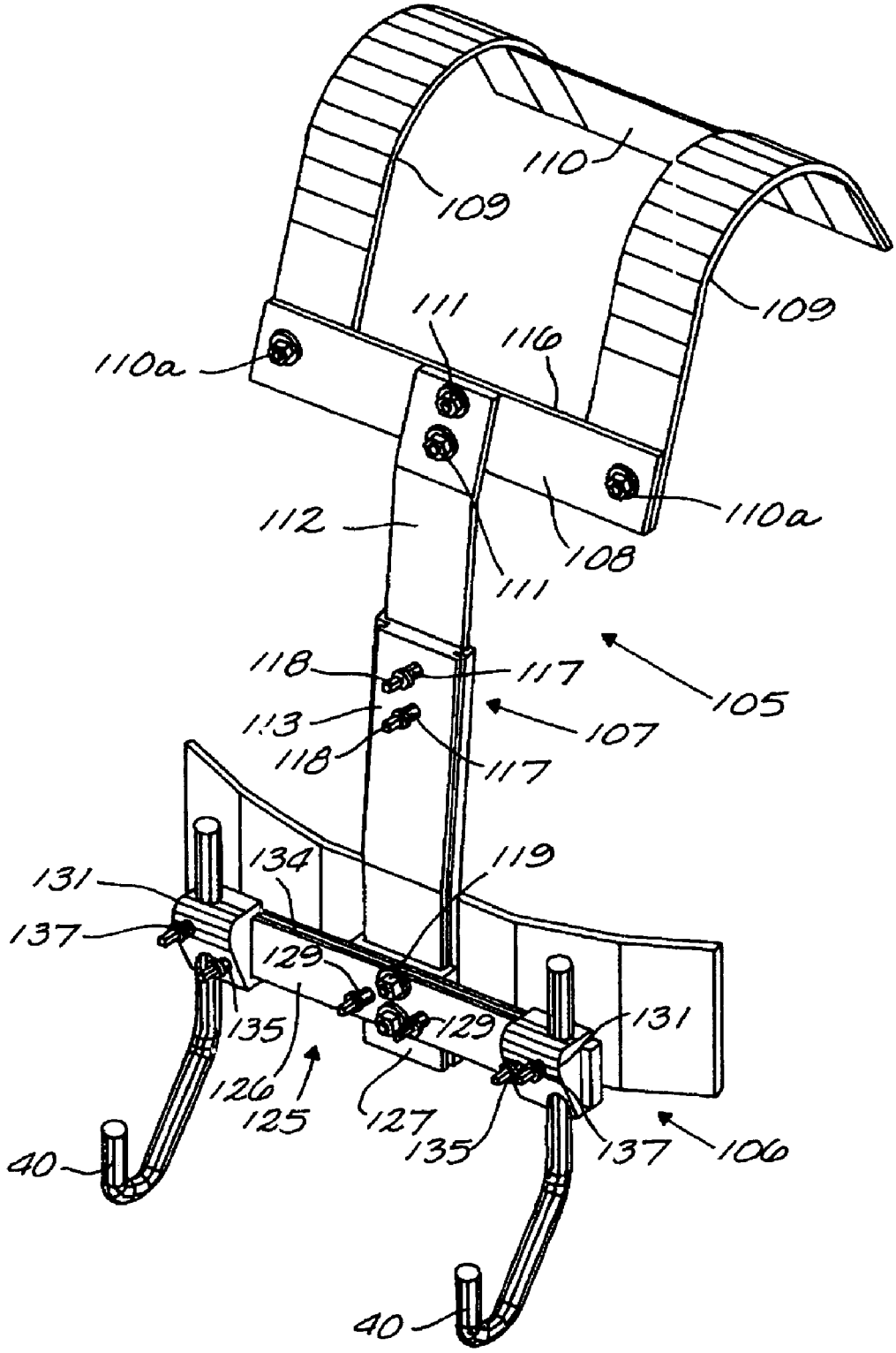
FIG. 1 is an isometric view of a novel T-bar assembly for supporting drums containing features permitting both vertical and lateral adjustment of the points of connection to drum supporting hardware and for positioning the drums.
Figure 2:
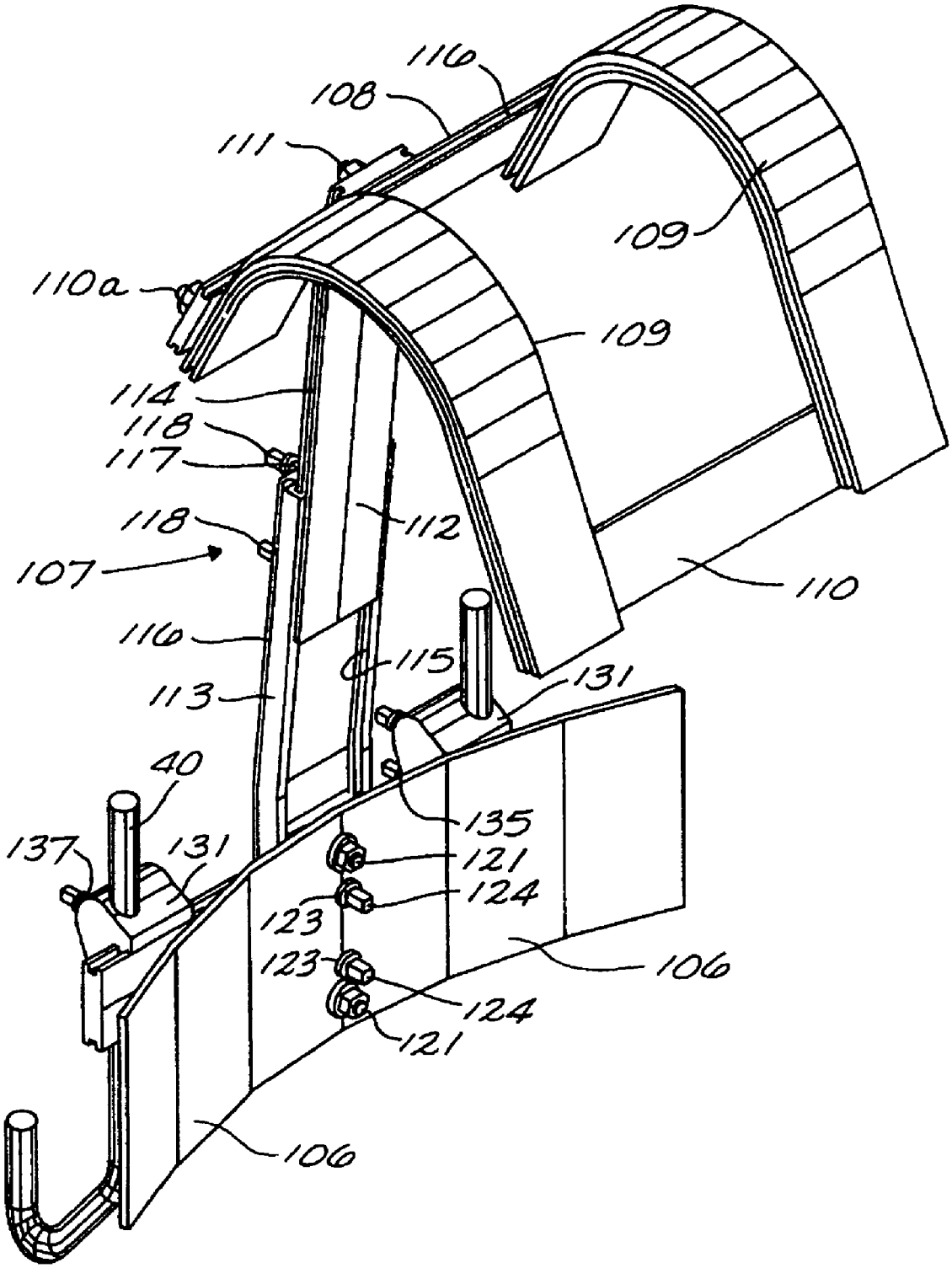
FIG. 2 is a rear isometric view of the T-bar assembly for supporting drums shown in FIG. 1.
Figure 3:
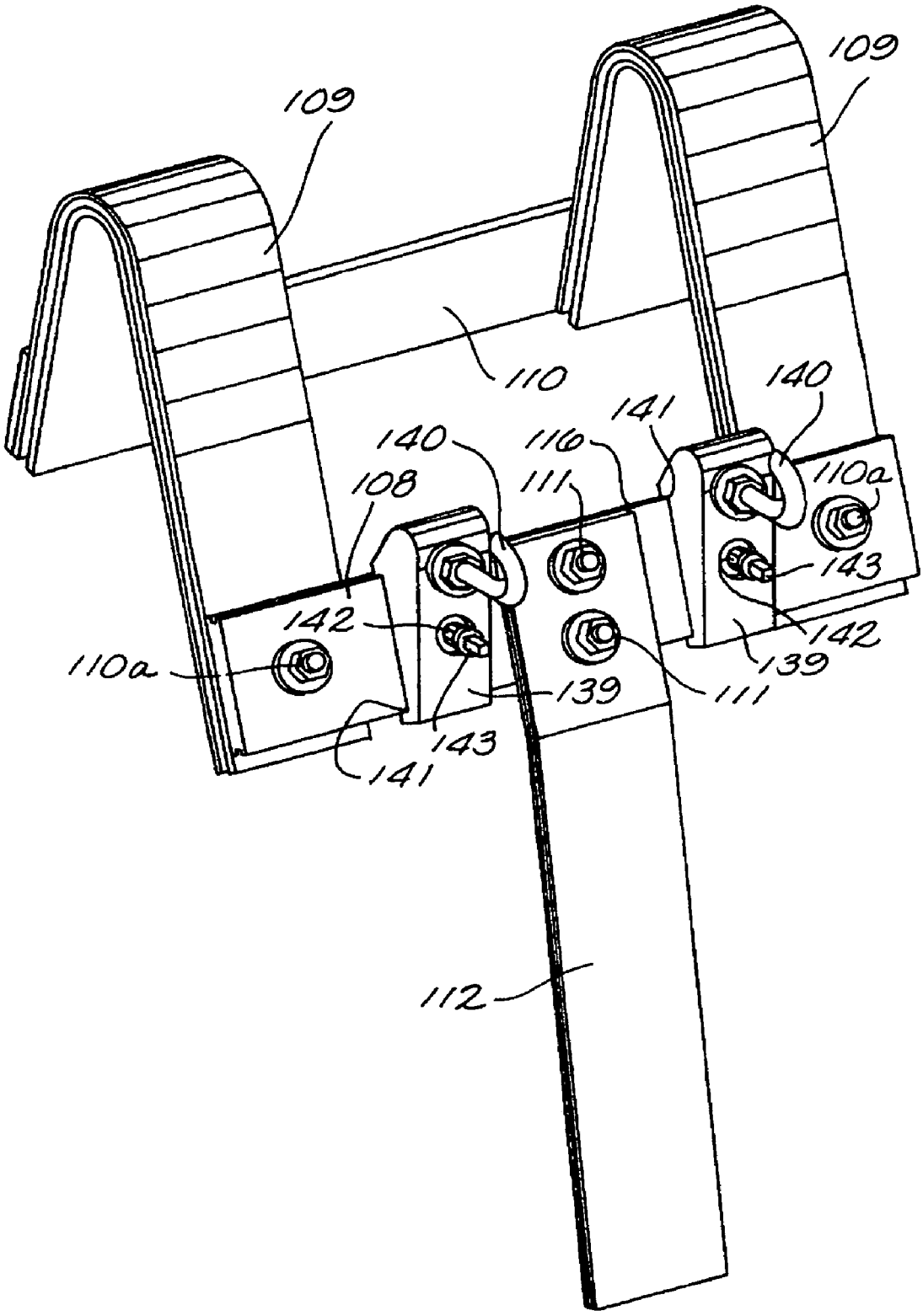
FIG. 3 is a detail isometric view of the shoulder straps, back bar, upper cross bar and upper vertical bar of the T-bar assembly shown in FIG. 1.
Figure 4:
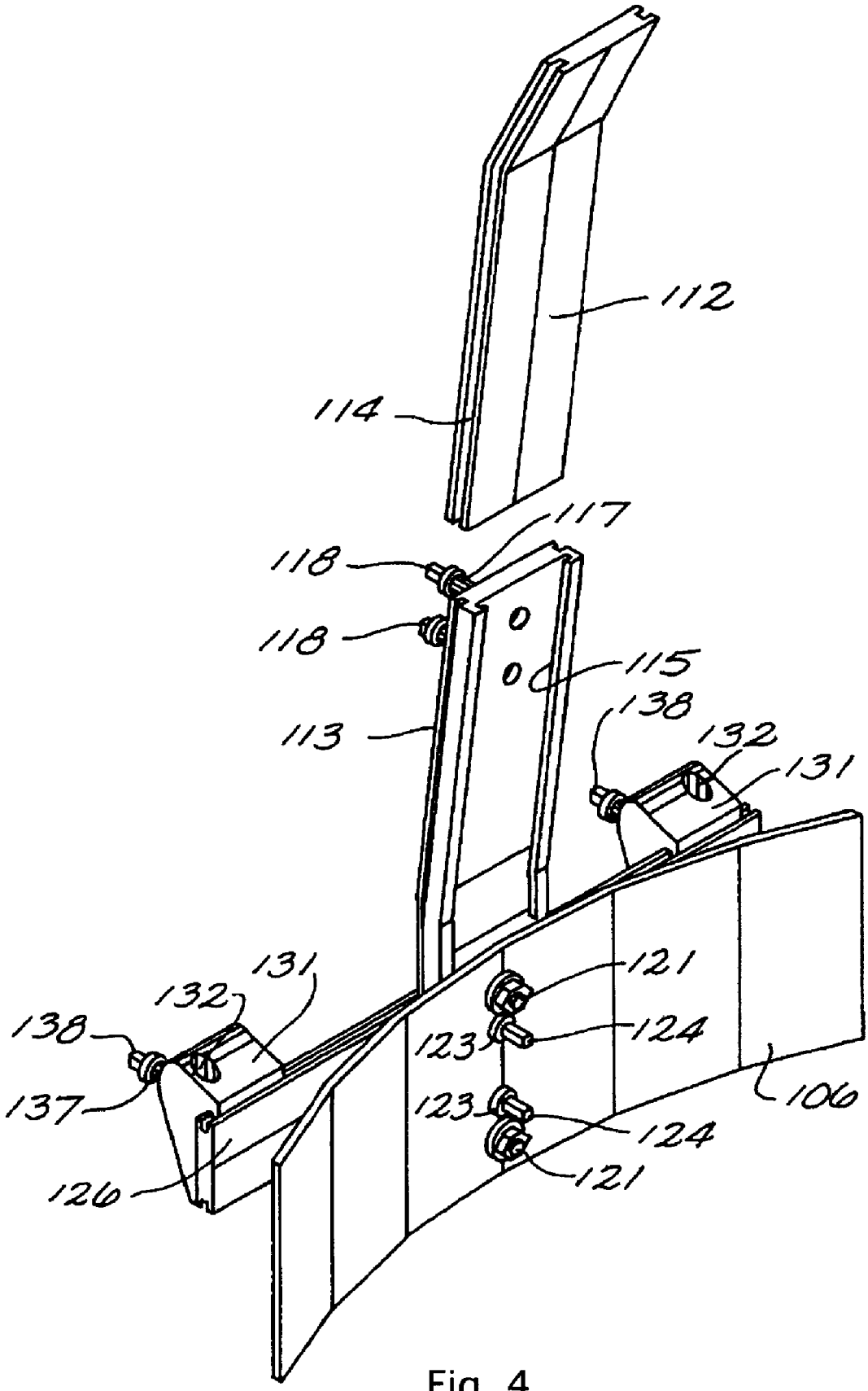
FIG. 4 is a detail rear isometric view of the lower vertical bar and belly plate of the T-bar assembly shown in FIG. 1.
Figure 5:
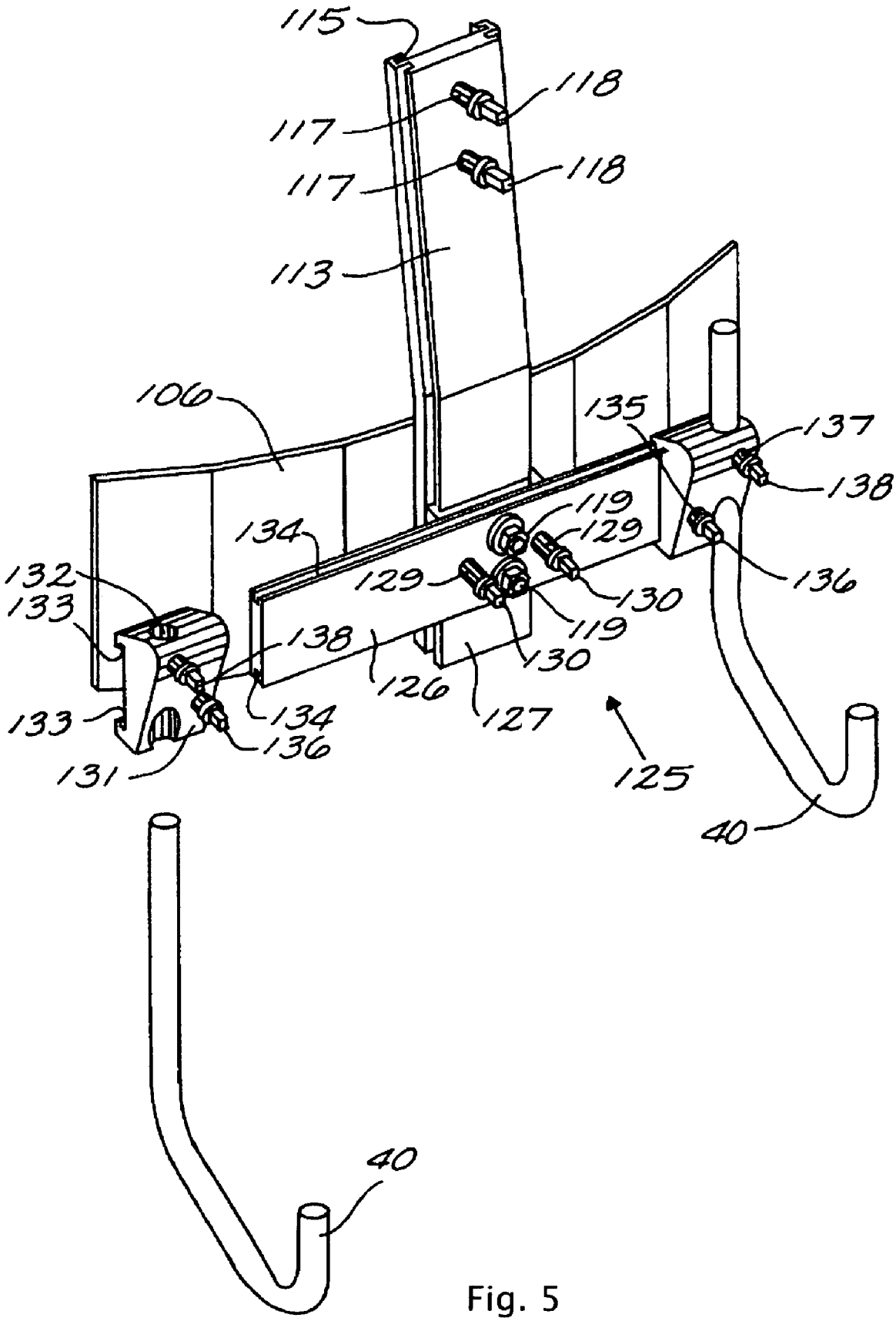
FIG. 5 is a detail front isometric view of the upper vertical bar, lower vertical bar and belly plate of the T-bar assembly shown in FIG. 4 with one of the J-bars in exploded relation.
Figure 6:
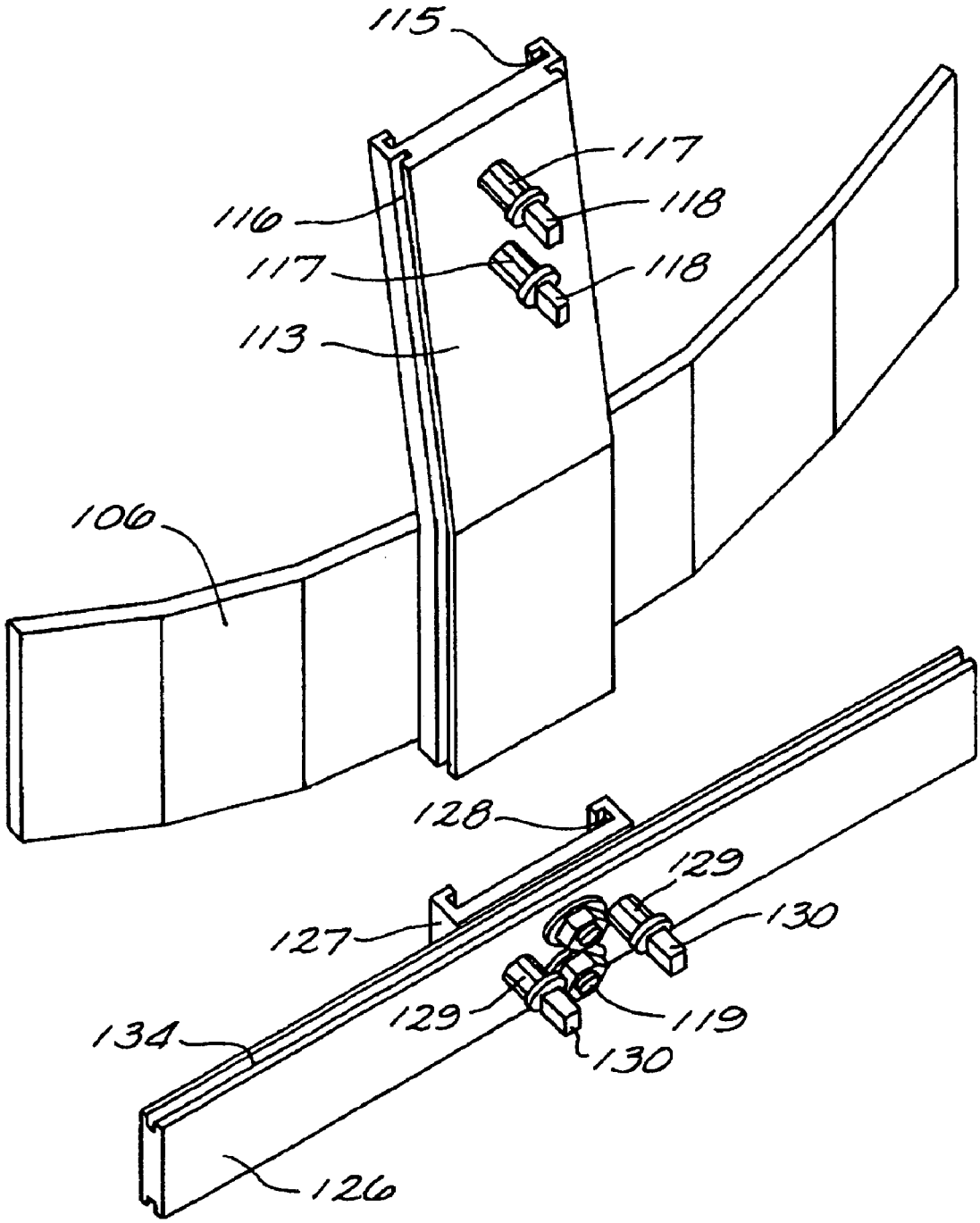
FIG. 6 is a detail front isometric view of the lower vertical bar, belly plate and lower cross bar of the T-bar assembly shown in FIG. 1 in exploded relation.
Figure 7:
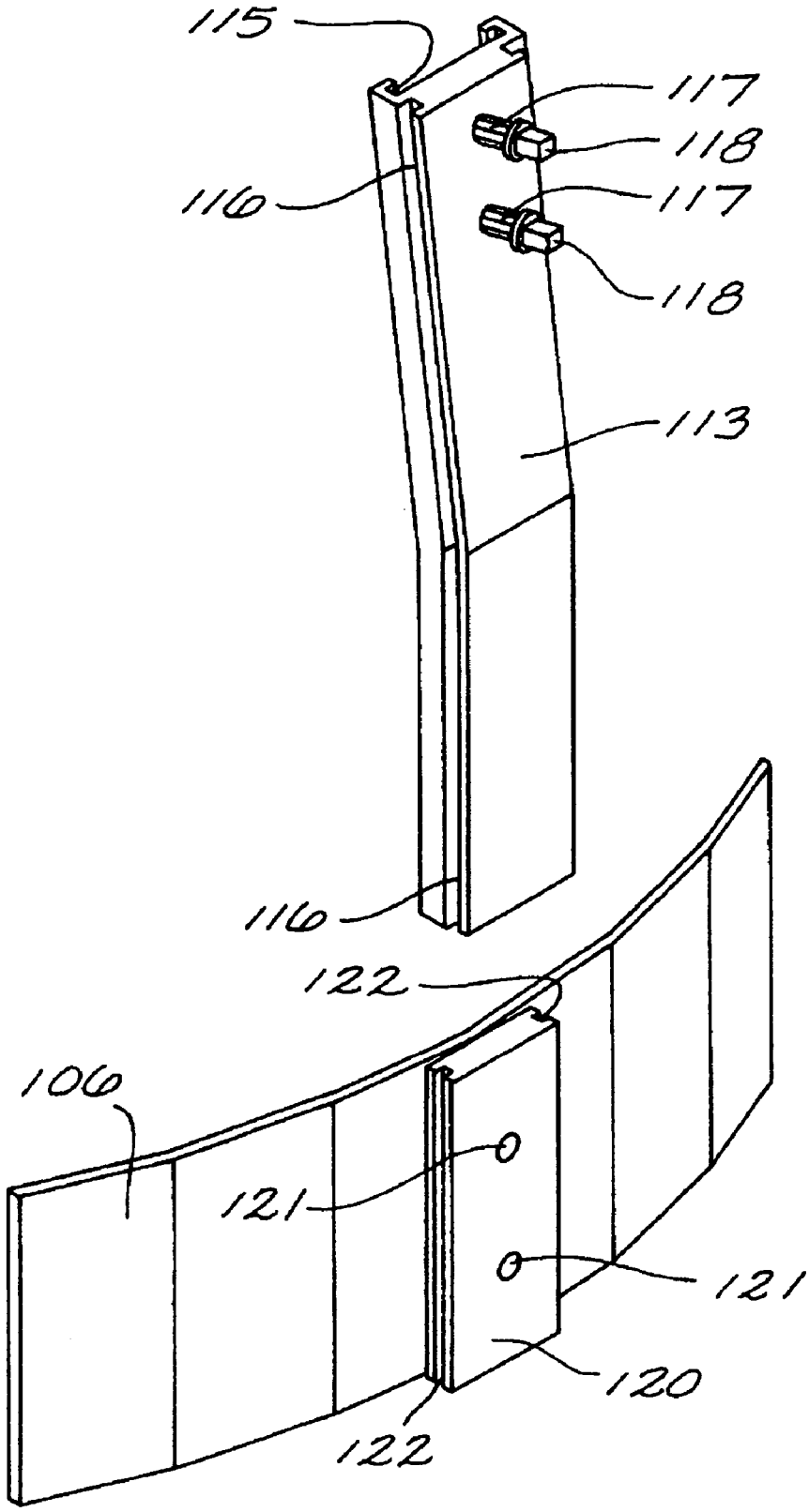
FIG. 7 is a detail front isometric view of the lower vertical bar and belly plate of the T-bar assembly shown in FIG. 1 in exploded relation.

Universally Adjustable Marching T-Bar Support for Drums and Other Percussion Instruments Referring to FIGS. 1-9, there is shown a T-bar-type carrier of the type shown which has been modified to provide almost universal adjustment of the points of attachment and location of the percussion instruments. Pads corresponding to the pads 104 on shoulder straps 109/148 used to cushion the load of the instruments carried by the carrier.

Adjustable carrier 105 (FIG. 1) for percussion instruments comprises a belly plate 106, vertical bar assembly 107, upper horizontal bar 108, shoulder straps 109 and back bar 110. Back bar 110 is removably secured to shoulder straps 109 by screws or bolts. Upper horizontal bar 108 is removably secured to shoulder straps 109 by bolts 110*a*. Upper horizontal bar 108 is removably secured to the upper end of vertical bar assembly 107 by bolts 111. Upper horizontal bar 108 has grooves 116 in the upper and lower edges for receiving adjustable sliding members in another embodiment of the invention.

Vertical bar assembly 107 (FIGS. 1 & 4) comprises an upper bar member 112 and lower bar member 113. Upper bar member 112 has a pair of longitudinal grooves 114 in opposite edges. Lower bar member 113 has a pair of inner grooves 115 on opposite sides thereof and a pair of outer grooves 116. Bar members 112 and 113 are assembled with grooves 114 and 115 in telescoping relation for adjustable movement of the bars. Lower bar member 113 has a pair of bolts 117 with square heads 118 which are adjustable into and out of engagement with upper bar member 112 to secure bar assembly 107 together in any predetermined position. Square heads 118 are of a size for operation by a standard drum key.

Belly plate 106 is secured to a short mounting bar 120 by flat headed bolts 121. (FIG. 7) Mounting bar 120 has edge grooves 122 of a size fitting grooves 115 in lower bar member 113 on which the mounting bar is assembled. Mounting bar 120 has a pair of bolts 123 with square heads 124 which are adjustable into and out of engagement with lower bar member 113 to secure the lower bar/mounting bar assembly together in any predetermined vertical location of the belly plate 106. Square heads 124 are of a size for operation by a standard drum key.

A J-rod receptor assembly 125 (FIGS. 1, 2, 4, 5, 6 & 8) consists of a fixed horizontal supporting bar 126, having edge grooves 134, and a supporting slide member 127 secured thereon by flat headed bolts 119. Slide member 127 has internal grooves 128 of a size fitting grooves 116 in lower bar member 113 on which the slide member is assembled. Supporting bar 126 has a pair of bolts 129 with square heads 130 which are adjustable into and out of engagement with lower bar member 113 to secure the lower bar/J-bar receptor assembly together in any predetermined vertical location relative to the belly plate 106. Square heads 124 are of a size for operation by a standard drum key.

J-rod receiving brackets 131 have vertical holes 132 sized to receive a J-rod 40 as in the other embodiments. Brackets 131, however, are adjustably supported on supporting bar 126. Brackets 131 have internal grooves 133 which fit supporting bar edge grooves 134 for sliding movement thereon and have bolts 135 with square heads 136 and bolts 137 with square heads 138. Square heads 136 and 138 are of a size for operation by a standard drum key. Bolts 135 set the position of brackets 131 on supporting bar 126 and bolts 137 secure J-rods 40 in place.

Figure 8:
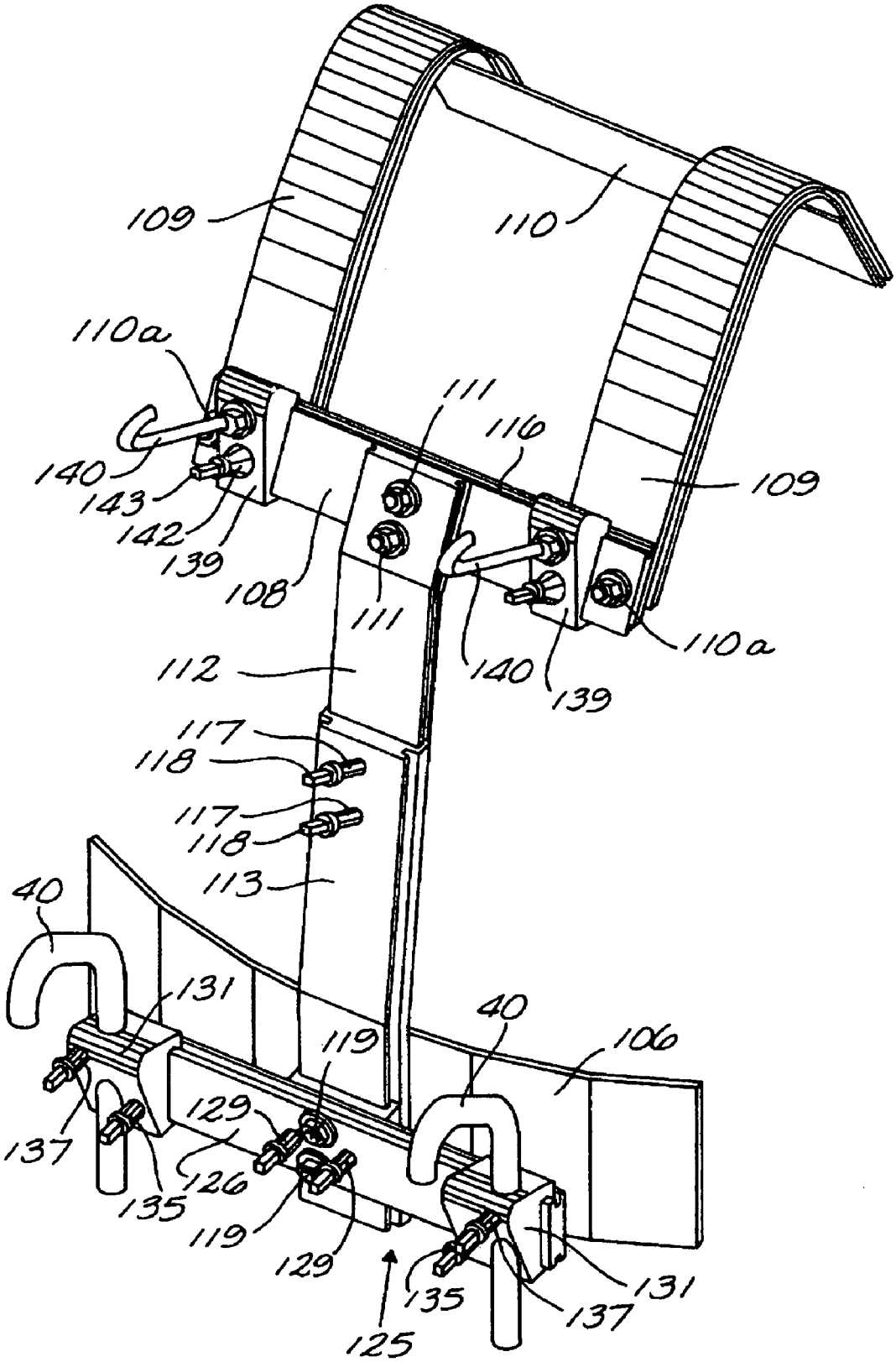
FIG. 8 is an isometric view of a novel T-bar assembly for supporting drums as in FIG. 1 modified for carrying a bass drum.

The embodiment of FIG. 8 is identical to that of FIG. 1 except that J-rods 40 are positioned upside down relative to the other embodiments and sliding brackets 139 are provided on upper horizontal bar 108. Brackets 139 have J-bolts 140 secured thereon to provide securing hooks where needed. Brackets 139 have internal grooves 141 which fit supporting bar edge grooves 116 for sliding movement thereon and have bolts 142 with square heads 143 of a size for operation by a standard drum key. Bolts 142 set the position of brackets 139 on upper supporting bar 108. In this embodiment, brackets 139 must be installed on supporting bar 108 before assembling shoulder straps 109 in place. The shoulder straps 109 have pads, as in the other embodiments.

The materials of construction used in this carrier are very important for achieving the desired result. The belly plate 106, J-rod supporting bar 126, vertical bars 112 and 113, upper horizontal bar 108, shoulder straps 109 and back bar 110 are semi-rigid and made of a light metal such as aluminum, magnesium or titanium. The metal shoulder straps have the advantage that different sizes are readily accommodated. The sub-assembly of the belly plate 106, J-rod supporting bar 126, vertical bars 112 and 113, and upper horizontal bar 108 can be of a single size and separate shoulder straps 109 of differing radii used for small, medium, large or extra large size.

The shoulder strap cushions are of a type used to pad the interior of football and other sports helmets. The construction is as described for cushions shown in prior U.S. Pat. No. 5,691,492 in FIG. 9. As described, the separate blocks are separately compressible and provide more comfort to the wearer of the carrier when fully loaded.

The assembly of this carrier is preferably carried out by forming two sub-assemblies and then assembling them together. Belly plate 106, suitably cushioned, is assembled on lower vertical bar 113 with grooves 122 fitted in sliding relation to internal grooves 115 and bolts 123 fixing the location. J-rod receptor supporting bar 126 is secured on its mounting slide 127 and slid into position on external grooves 116 on lower vertical bar 113 and fixed in position by tightening bolts 129. J-rod receptor brackets 131 are slid into position on supporting bar grooves 134 and fixed in position by tightening bolts 135. This completes the lower sub-assembly.

The upper sub-assembly is produced by fastening the upper vertical bar 112 to upper horizontal bar 108. If upper brackets 139 are used, they are installed next. In either case, upper horizontal bar 108 is assembled to shoulder straps 109 and back bar 110 is secured thereon. The cushioning is then installed on the underside of shoulder straps 109 and back bar 110. This sub-assembly is now complete.

The upper sub-assembly and lower sub-assembly are then assembled by fitting upper vertical bar 112 into sliding relation in lower vertical bar 113. Grooves 114 in bar 112 fit into grooves 115 in bar 113 in sliding relation. The bars 112 and 113 are fixed in position by tightening bolts 118. The assembly is now complete.

Operation

The operation of this carrier should be apparent but will be described briefly for clarity. The carrier 105 is worn by the musician with the shoulder straps 109 positioned over the shoulders and the belly plate 106 supported against his abdomen. Belly plate 106, back bar 110, and shoulder straps 109 upper horizontal bar 108 may have suitable padding over their inner surfaces to avoid discomfort. J-rods 40 are inserted in position and secured in place by tightening bolts 137. The short outer ends of the J-rods are inserted into the J-rod receptacles on the percussion instrument being carried, e.g., drums (single or array), cymbals, xylophone, marimba, or the like.

The carrier is universally adjustable. The positioning of the belly plate 106 is adjusted by adjusting the length of the vertical bar assembly 107 by sliding bars 112 and 113 to a desired position and re-tightening the set bolts 117. The lateral spacing of the J-rod supporting brackets 131 is adjustable by loosening bolts 135, setting brackets 131 to the desired position and retightening bolts 135. J-bolts 40 are set to the desired vertical position and angular orientation by set bolts 137. In the embodiment of FIG. 26, the upside-down positioning of J-rods 40 and the use of upper brackets 139 fits the connections to a bass drum for carrying on this carrier.

T-Bar Support and Hardware for Drums and Cymbal

Figure 9:
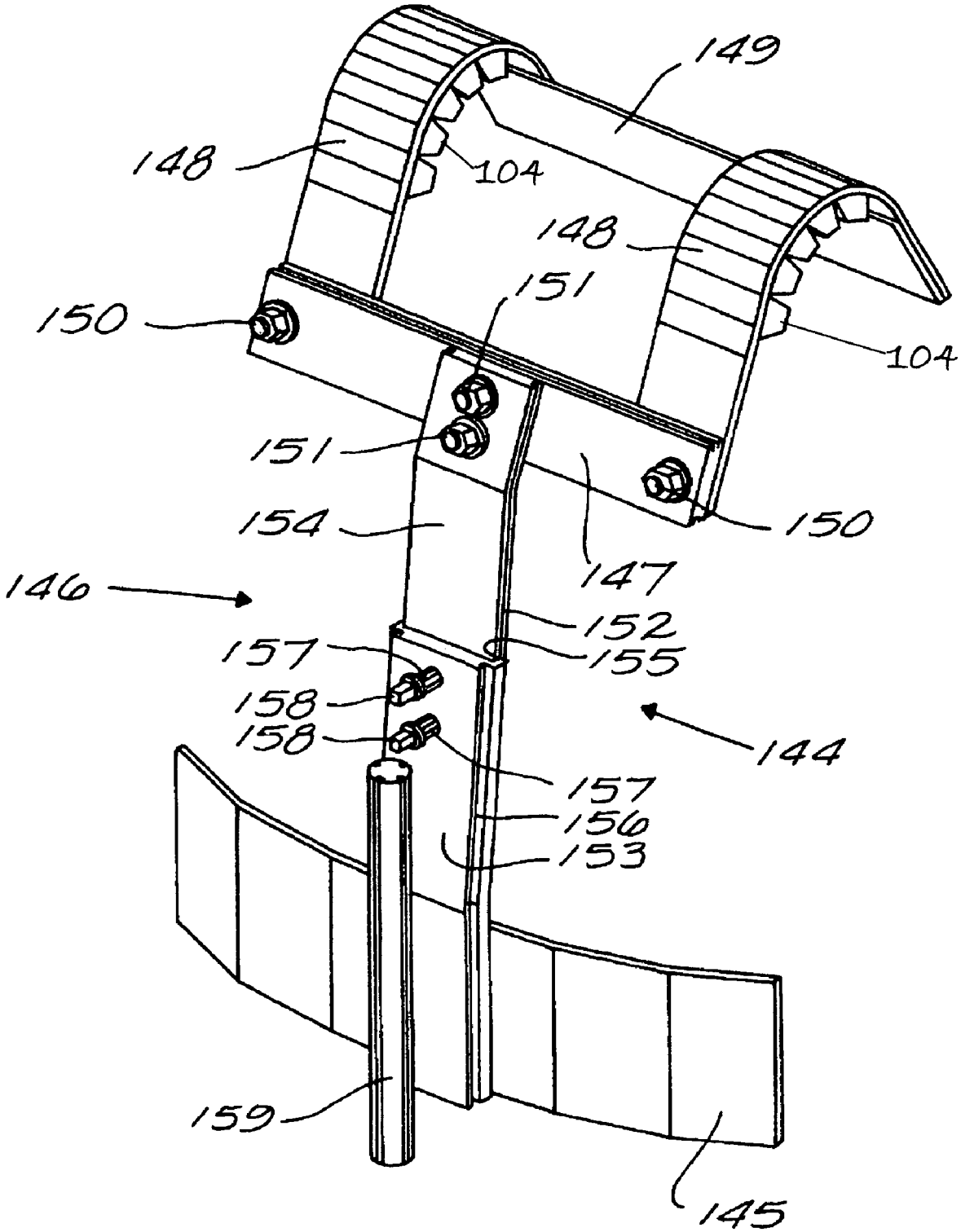
FIG. 9 is an isometric view of a novel T-bar assembly having a clamp holding a fluted tube for supporting cymbals.

Referring to FIG. 9, there is shown a T-bar-type carrier of the type shown in FIG. 1 and associated hardware which is especially useful in supporting cymbals, alone or together with snare drums or the like.

Adjustable carrier 144 (FIG. 9) for percussion instruments, especially cymbals, comprises a belly plate 145, vertical bar assembly 146, upper horizontal bar 147 and shoulder straps 148. Back bar 149 is optional and may be made integral with the shoulder straps by welding or may be removably secured to shoulder straps 148 by screws or bolts. Upper horizontal bar 147 is removably secured to shoulder straps 148 by bolts 150. Upper horizontal bar 147 is removably secured to the upper end of vertical bar assembly 146 by bolts 151.

Vertical bar assembly 146 comprises an upper bar member 154 and lower bar member 153. Upper bar member 154 has a pair of longitudinal grooves 152 in opposite edges. Lower bar member 153 has a pair of inner grooves 155 on opposite sides thereof and a pair of outer grooves 156. Bar members 152 and 153 are assembled with grooves 152 and 155 in telescoping relation for adjustable movement of the bars. Lower bar member 153 has a pair of bolts 157 with square heads 158 which are adjustable into and out of engagement with upper bar member 154 to secure bar assembly 146 together in any predetermined position. Square heads 158 are of a size for operation by a standard drum key.

Belly plate 145 is secured to a short mounting bar, see FIGS. 1, 2, 4, 5 and 8, by flat headed bolts. The mounting bar has edge grooves of a size fitting grooves 155 in lower bar member 153 on which the mounting bar is assembled. The mounting bar has a pair of bolts with square heads (see FIGS. 1-8) which are adjustable into and out of engagement with lower bar member 153 to secure the lower bar/mounting bar assembly together in any predetermined vertical location of the belly plate 145. The square heads are of a size for operation by a standard drum key.

A fluted tube 159 is secured on lower bar member 153 or optionally on belly plate 145 for supporting pivot arms and cymbal-supporting as described below. The assembly of fluted tube 159 and pivot arms is constructed the same as the supporting rod and pivoted legs in May U.S. Pat. No. 5,072,910 with the pivoted legs of the patent being adapted herein as pivoted arms for supporting cymbal hardware. Tubular member 159 has a plurality of circumferentially spaced grooves extending longitudinally on its exterior surface.

Adjustable Two-Part Vest

Figure 10:
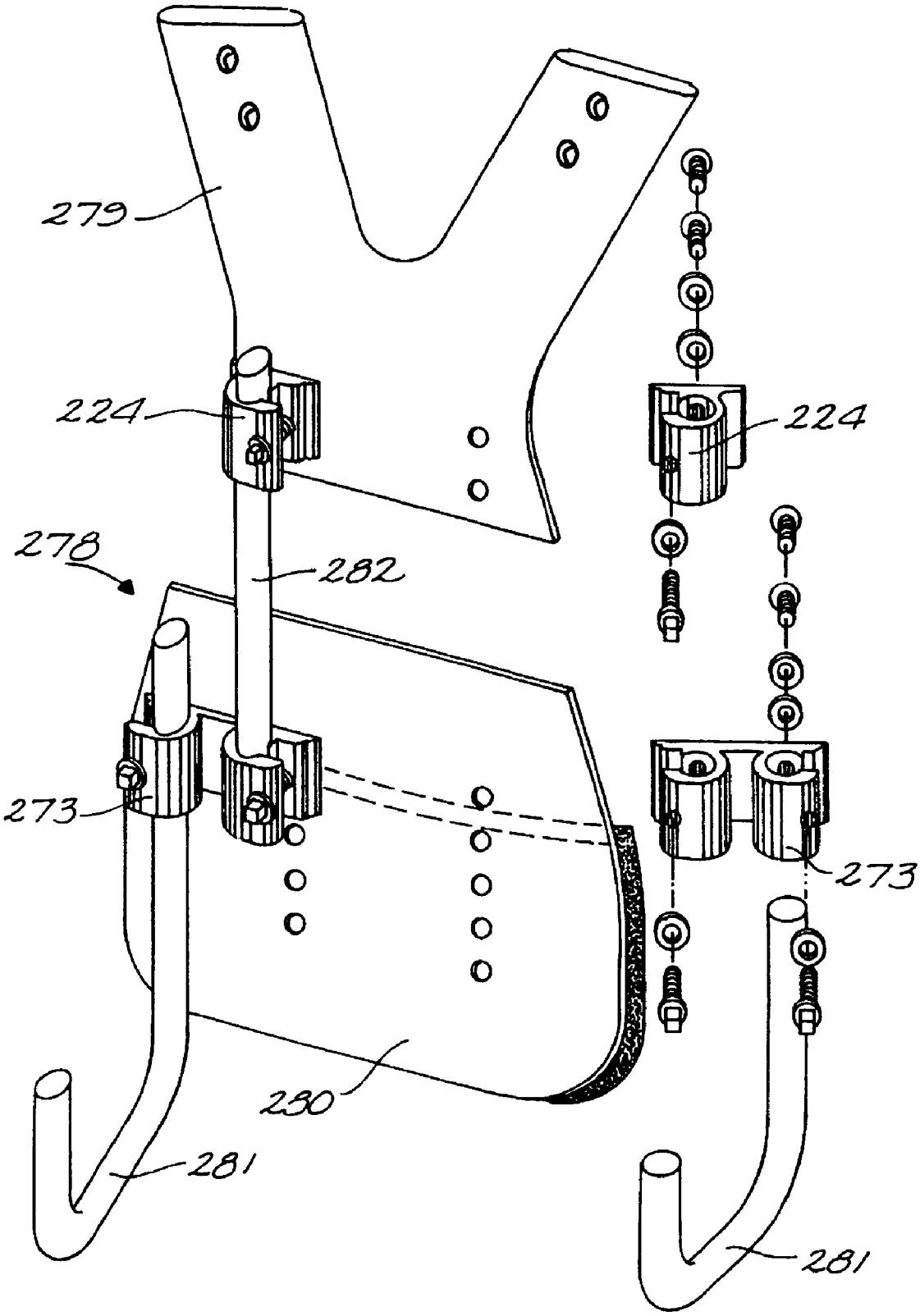
FIG. 10 is an exploded view of a vest assembly with two parts supported for adjustable movement by the double clamp.

In FIG. 10, supporting member or carrier comprises a vest assembly 278 having two separate vest pieces 279, which connects to the shoulder straps, and 280, which supports the J-rods 281. A pair of J-rod or post receptacles 224 are secured on the upper vest piece 279. A pair of the double facing receptacles 273 are secured on the lower vest piece 280. J-rods 281 are secured and clamped in receptacles 273 on opposite sides of the lower vest piece 280. A pair of posts 282 (only one is shown) are secured at one end in receptacle 273 and at the other end in receptacles 224. The pieces 279 and 280 are adjusted to a desired position and the key-operated bolts are tightened to clamp both ends of the posts 282 tightly.

Monolithic Carrier with Multi-Part Vest

Figure 11:
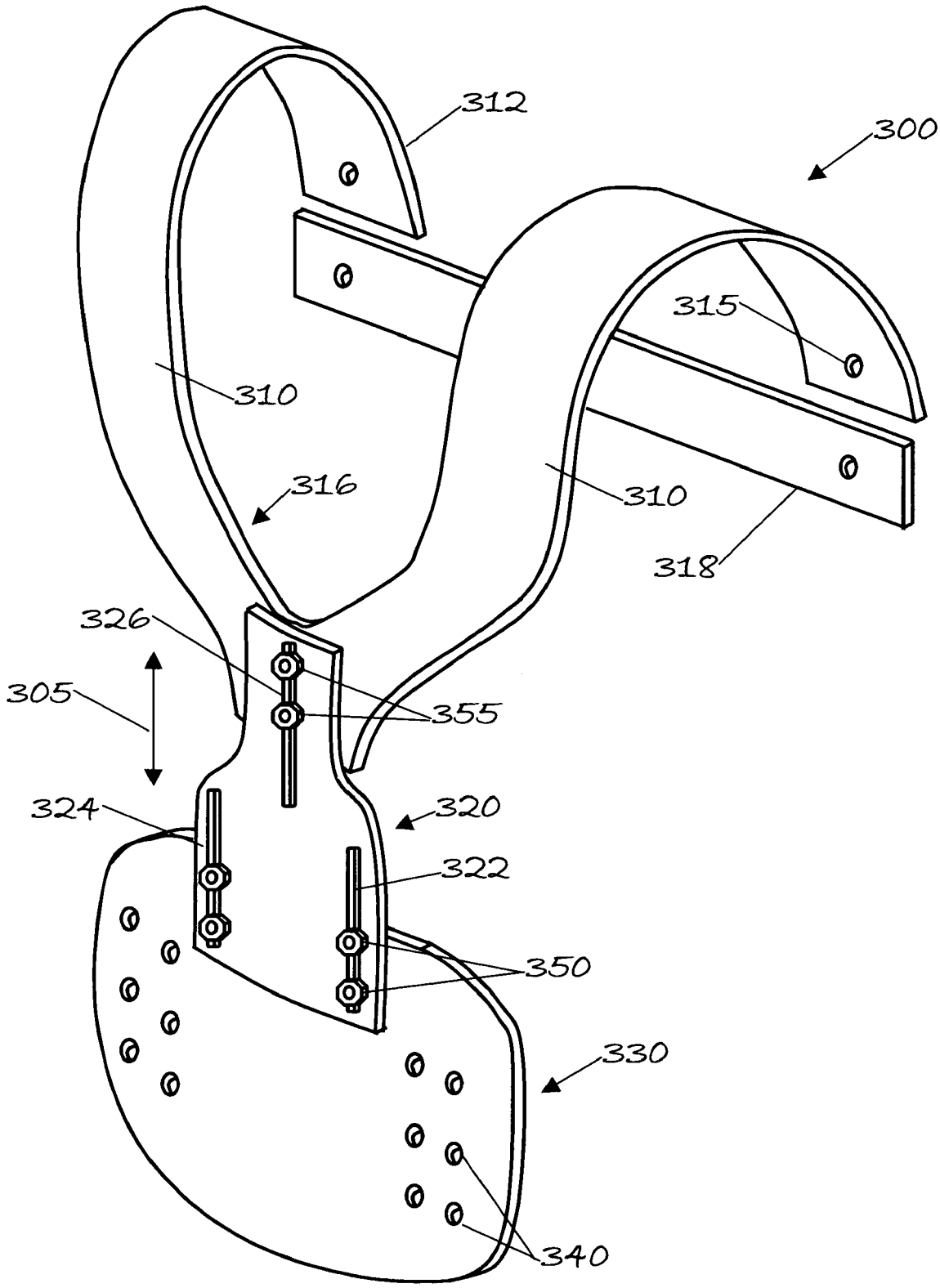
FIG. 11 is an isometric view of a vest type carrier with integrated shoulder supports, back member connection holes and multiple front adjustable components.

FIG. 11 is an isometric view of a vest type carrier 300 with integrated shoulder supports, back member connection holes and multiple front adjustable components. The multiple front adjustment components allow the distance between the upper carrier 316 and the lower carrier 330 to be adjusted to accommodate users of different sizes. The shoulder supports may include padding as previously described to aid fit or comfort of the user. The figure shows the front of the carrier configured as a vest type carrier. This carrier can be considered a "Y", "U" or "V" shaped carrier because the two shoulder supports 310 split from a single yoke 316. Various cosmetic orientations are possible where a single yoke splits into the shoulder straps without deviating from the basic configuration of the shoulder supports being joined in the front of the user. FIGS. 1-10 show other possible configurations where the shoulder straps join in the front of the carrier and provide a vertical adjustment component. Other configurations are contemplated that allow the distance 305 between the upper and lower portions of the carrier to be adjustable. The connecting member 320 is shown in this figure as a plate, but the connecting member can be a tube, rod, plate, post, strap, or extrusion. It is also contemplated that the intermediate member 320 can be incorporated into the upper component 316 or the lower component 330. The mid component 320 may also consist of more than one discreet component.

The rigid shoulder straps 310 extend from the front yoke of the carrier 316 over the shoulders of the user to behind the user 312. The shoulder straps terminate behind the user with a back member 318. The back member may be monolithically integrated into the shoulder straps, or removable connectable with the shoulder straps as shown in this figure. When the back support is removable the back member can be attached to the shoulder supports with mounting hole 315 or other hardware that allows the back member to be connected or attached to the shoulder supports. The back member 318 may include padding as previously described to aid in the fit or comfort of the user. The back member may also be adjustable to accommodate different carrier or to allow the position of the back member to be adjusted for the comfort of the musician.

The mounting hardware for mounting instruments is not present in this figure, but the holes 340 are used for mounting J-rod or similar drum mounting hardware. In this figure, three pairs of mounting holes are located on each side of the lower section 330 of the carrier. The multiple holes 340 allow for each set of the J-rod or similar holders to be positioned in multiple positions or heights on the carrier. The configuration of the J-rod mounting has been previously disclosed in this and other CIP applications from the inventor.

In this figure, a front adjustment plate 320 is shown that has multiple adjustable slots 322, 324 and 326. Each of these slots allow for the upper and lower components or members of the carrier to be linearly moved, translated or slid closer or further together. While this plate 320 shows slots to allow for an infinite number of adjustment positions, one or multiple discreet positions or holes can be incorporated into the carrier to allow for finite positioning of the upper and lower carrier components. In this embodiment, the components are locked into position using hardware such as screws or nuts 350 and 355 that secure the components once the size of the carrier is established. The connection between the components can be secured using square heads that are of a size for operation by a standard drum key.

Operation

The operation of this carrier should be apparent but will be described briefly for clarity. The carrier 300 is worn by the musician with the shoulder straps 310 positioned over the shoulders and the vest sections 316, 320 and 330 supported against his abdomen of the musician. Once the carrier is placed upon the musician, the locking mechanism(s) 355 and or 350 can be loosened to allow the components of the carrier 316, 320 and or 330 to be adjusted for optimal fit to the musician. Once the preferred position of the carrier is fit to the user the hardware can be locked down to prevent the carrier components from moving. The J-rod or other instrument carrying hardware can also be adjusted to the preference of the user as previously disclosed in this application.

Thus, specific embodiments and applications for a removable and or adjustable back member for a percussion instrument carrier have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A vertically adjustable shoulder supported harness assembly for supporting percussion musical instruments, comprising:

a monolithic upper support section comprising at least two rigid shoulder supporting members for securing said section on the shoulders of a user where said at least two rigid shoulder supporting members for extending over the shoulders of a user during use and join in a front connecting yoke defining any one of a "U" shape, or "Y" shape, or "V" shaped or a combination thereof;

at least one back support secured to said upper support section, each said back support is connect to the front of the carrier and to said user only from a connection by way of said at least two rigid shoulder supporting members over the shoulders of the user;

a lower support section including structure for supporting musical instruments; and at least one vertically adjustable connection between said upper support section and said lower support section.

2. The vertically adjustable shoulder supporting harness assembly for supporting percussion musical instruments as defined in claim 1 wherein said monolithic upper support section includes an adjustable third section located between said upper support sections and said lower support section.

3. The vertically adjustable shoulder supporting harness assembly for supporting percussion musical instruments as defined in claim 1 wherein said lower support section includes attachment means for at least two "J" rods, said "J" rods being independently adjustable in said attachment means.

4. The vertically adjustable shoulder supporting harness assembly for supporting percussion musical instruments as defined in claim 1 wherein said at least one vertically adjustable connection between said upper and lower support sections comprises at least one tube, or one rod, or one post, or one strap, or one extrusion.

5. The front adjustable shoulder supporting percussion musical instrument carrier as defined in claim 1 wherein said vertically adjustable connection provides for infinite connection positions.

6. The front adjustable shoulder supporting percussion musical instrument carrier as defined in claim 1 that further includes at least one elongated slots or track for guided vertical movement between said monolithic upper support section and said lower support section.

7. The vertically adjustable shoulder supported harness assembly for supporting percussion musical instruments as defined in claim 1 that further includes padding.

8. The front adjustable shoulder supporting musical instrument carrier as defined in claim 1 wherein the at least one back support connects said at least two shoulder supporting members behind the user and does not encircle the user to the front of the carrier under one or both arms of the user.

9. The front adjustable shoulder supporting musical instrument carrier as defined in claim 1 wherein the at least one back support connects said at least two shoulder supporting members behind the user and does not include securing means that wrap around the sides of the user.

10. The vertically adjustable shoulder supporting harness assembly for supporting percussion musical instruments as defined in claim 1 wherein neither said shoulder supports or said back member(s) extend around a side of the user.

11. A front adjustable shoulder supporting a percussion musical instrument carrier, comprising:

a shoulder supporting section including at least two rigid shoulder supports;

a front member connecting said at least two shoulder supports in front of a user;

one or more back member(s) connecting to said front member only from a connection with said at least two shoulder supports;

a percussion musical instrument supporting section located substantially below said shoulder supporting section including a structure for supporting percussion musical instruments;

at least one vertically adjustable link in front of said carrier between said shoulder supporting section and said musical instrument supporting section such that said shoulder supporting section and said percussion musical instrument supporting section can be transitioned towards or away from each other while maintaining a playing surface of a percussion musical instrument in an essentially perpendicular relationship with said front member, and a lower abdomen supporting section that is vertically adjustable independent from said at least one of said shoulder supporting section and said percussion musical instrument supporting section.

12. The front adjustable shoulder supporting percussion musical instrument carrier as defined in claim 11 wherein said shoulder supporting section including said at least two shoulder supports, and a removable or adjustable rigid back member connecting said two shoulder supports behind said user; and wherein said front member connecting said two shoulder supports in front of said user is of a monolithic construction.

13. The front adjustable shoulder supporting percussion musical instrument carrier as defined in claim 12 wherein said percussion musical instrument supporting section includes attachment means for at least two "J" rods and allows for independent adjustment of "J" rods that is independent from the carrier structure.

14. The front adjustable shoulder supporting percussion musical instrument carrier as defined in claim 11 wherein said vertically adjustable link comprises at least one plate, or one tube, or one rod, or one post, or one strap, or one extrusion.

15. The front adjustable shoulder supporting percussion musical instrument carrier as defined in claim 11 wherein said at least one vertically adjustable link provides for a finite number of positions in an infinite guided track where said shoulder supporting section and said musical instrument supporting section can be transitioned towards or away from each other with an adjustment located only in the front of said carrier.

16. The front adjustable shoulder supporting percussion musical instrument carrier as defined in claim 11 wherein said vertically adjustment of said vertically adjustable link provides for an infinite number of locations where said shoulder supporting section and said musical instrument supporting section can be transitioned towards or away from each other with an adjustment located in the front of said carrier.

* * * * *